US012158007B2

(12) United States Patent
Osmanski et al.

(10) Patent No.: US 12,158,007 B2
(45) Date of Patent: Dec. 3, 2024

(54) FACADE SUPPORT SYSTEM

(71) Applicant: Hohmann & Barnard, Inc., Hauppauge, NY (US)

(72) Inventors: Richard Osmanski, Hauppauge, NY (US); Christopher Mason, Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 270 days.

(21) Appl. No.: 17/161,798

(22) Filed: Jan. 29, 2021

(65) Prior Publication Data

US 2021/0238861 A1 Aug. 5, 2021

Related U.S. Application Data

(60) Provisional application No. 62/968,671, filed on Jan. 31, 2020.

(51) Int. Cl.
*E04F 13/08* (2006.01)
*E04B 1/41* (2006.01)

(52) U.S. Cl.
CPC ..... *E04F 13/0805* (2013.01); *E04B 1/4178* (2013.01)

(58) Field of Classification Search
CPC ... E04F 13/0805; E04F 13/14; E04F 13/0801; E04F 13/22; E04B 1/4178
See application file for complete search history.

(56) References Cited

U.S. PATENT DOCUMENTS

| | | | | |
|---|---|---|---|---|
| 779,268 | A | 1/1905 | Elliott | |
| 1,697,003 | A | 1/1929 | Fink | |
| 2,073,795 | A | 12/1936 | Haugaard | |
| 2,302,920 | A * | 11/1942 | Sobie | E04H 13/006 52/379 |
| 2,363,156 | A | 11/1944 | Sinner et al. | |
| 3,050,160 | A | 8/1962 | Chesser | |
| 3,234,702 | A | 2/1966 | Zibell | |
| 3,414,224 | A | 12/1968 | Robilliard et al. | |

(Continued)

FOREIGN PATENT DOCUMENTS

| | | |
|---|---|---|
| BE | 1003846 A3 | 6/1992 |
| CA | 1 155 329 A | 10/1983 |

(Continued)

OTHER PUBLICATIONS

IG Steel Lintels Masonry Support & Windpost Systems, Wayback Machine, Aug. 18, 2013, pp. 1-36.

(Continued)

*Primary Examiner* — Andrew J Triggs
(74) *Attorney, Agent, or Firm* — Andrus Intellectual Property Law, LLP

(57) ABSTRACT

A facade support system for attachment to a floor of a structure for supporting a veneer includes a bracket and a support. The bracket attaches to the floor. The bracket includes a back panel, a connecting member extending from the back panel in a first direction and a top flange extending from the back panel in a second direction that is generally opposite the first direction. The top flange attaches to an underside of the floor. The support attaches to the connecting member of the bracket and is to be disposed in a mortar bed joint of the veneer.

20 Claims, 8 Drawing Sheets

(56) References Cited

U.S. PATENT DOCUMENTS

| | | | | |
|---|---|---|---|---|
| 3,450,427 | A | 6/1969 | Fischer | |
| 3,680,271 | A | 8/1972 | Satchell | |
| 3,942,292 | A | 3/1976 | Robinson | |
| 4,013,253 | A | 3/1977 | Perrault et al. | |
| 4,390,103 | A | 6/1983 | Husband | |
| 4,515,494 | A | 5/1985 | Robilliard et al. | |
| 4,805,364 | A | 2/1989 | Smolik | |
| 4,827,684 | A | 5/1989 | Allan | |
| 4,869,043 | A | 9/1989 | Hatzinikolas et al. | |
| 5,035,099 | A | 7/1991 | Lapish | |
| 5,063,715 | A | 11/1991 | Goodman | |
| 5,082,388 | A | 1/1992 | Lauterbach | |
| 5,236,625 | A | 8/1993 | Bardo et al. | |
| 5,265,396 | A | 11/1993 | Amimoto | |
| 5,313,752 | A | 5/1994 | Hatzinikolas | |
| 5,392,581 | A | 2/1995 | Hatzinikolas et al. | |
| 5,619,834 | A | 4/1997 | Chen | |
| 5,720,571 | A * | 2/1998 | Frobosilo | E04B 2/96 403/231 |
| 5,816,008 | A | 10/1998 | Hohmann | |
| 6,109,461 | A * | 8/2000 | Kluge | A47B 57/30 211/187 |
| 6,128,883 | A | 10/2000 | Hatzinikolas | |
| 6,161,709 | A | 12/2000 | Kluge et al. | |
| 6,212,841 | B1 * | 4/2001 | Plume | E04B 1/4185 52/565 |
| 6,298,620 | B1 | 10/2001 | Hatzinikolas | |
| 6,397,552 | B1 * | 6/2002 | Bourque | E04B 1/003 52/712 |
| 6,584,741 | B1 | 7/2003 | Hatzinikolas | |
| 6,973,756 | B2 | 12/2005 | Hatzinikolas | |
| D550,540 | S | 9/2007 | Nawrocki | |
| 7,367,165 | B2 | 5/2008 | Hatzinikolas | |
| 7,392,911 | B2 | 7/2008 | Stitchick et al. | |
| 7,415,803 | B2 | 8/2008 | Bronner | |
| 7,469,659 | B2 | 12/2008 | de Jonge et al. | |
| 7,654,058 | B2 | 2/2010 | Hatzinikolas | |
| 7,908,804 | B2 | 3/2011 | Vieira | |
| 8,051,621 | B2 | 11/2011 | Hatzinikolas | |
| 8,117,785 | B2 * | 2/2012 | Teichner | E04D 13/076 52/12 |
| 8,333,048 | B2 | 12/2012 | Talpe | |
| 8,490,340 | B2 | 7/2013 | Hatzinikolas | |
| 8,490,341 | B2 | 7/2013 | Hatzinikolas | |
| 8,511,032 | B2 * | 8/2013 | Abdel-Rahman | E04B 2/88 52/573.1 |
| 8,516,763 | B2 | 8/2013 | Hohmann, Jr. | |
| 8,555,595 | B2 | 10/2013 | Hatzinikolas | |
| 8,621,802 | B2 | 1/2014 | Spyrou | |
| 8,667,763 | B2 | 3/2014 | Hatzinikolas | |
| 8,893,452 | B2 | 11/2014 | Hatzinikolas | |
| 8,955,263 | B2 | 2/2015 | Hatzinikolas | |
| 9,010,050 | B2 | 4/2015 | Hatzinikolas | |
| 9,010,062 | B2 | 4/2015 | Hill | |
| 9,027,301 | B2 | 5/2015 | Guinn | |
| 9,234,344 | B2 | 1/2016 | Hatzinikolas | |
| 9,316,004 | B1 | 4/2016 | Hatzinikolas | |
| 9,447,585 | B2 | 9/2016 | Hatzinikolas | |
| 10,294,676 | B2 | 5/2019 | Hatzinikolas | |
| 10,323,419 | B2 | 6/2019 | Hatzinikolas | |
| 11,118,358 | B2 * | 9/2021 | Hatzinikolas | E04F 13/0857 |
| 2004/0221535 | A1 | 11/2004 | Hatzinikolas | |
| 2005/0246987 | A1 | 11/2005 | Hatzinikolas | |
| 2006/0053743 | A1 | 3/2006 | Hatzinikolas | |
| 2006/0272251 | A1 | 12/2006 | Hatzinikolas | |
| 2008/0098681 | A1 | 5/2008 | Hatzinikolas | |
| 2010/0088992 | A1 | 4/2010 | Hatzinikolas | |
| 2010/0287864 | A1 | 11/2010 | Hatzinikolas | |
| 2010/0287865 | A1 | 11/2010 | Hatzinikolas | |
| 2011/0061337 | A1 | 3/2011 | O'Shea et al. | |
| 2012/0005981 | A1 | 1/2012 | Hatzinikolas | |
| 2012/0125646 | A1 | 5/2012 | Hatzinikolas | |
| 2012/0192504 | A1 | 8/2012 | Hatzinikolas | |
| 2012/0279143 | A1 | 11/2012 | Hatzinikolas | |
| 2014/0150373 | A1 | 6/2014 | Hatzinikolas | |
| 2014/0174014 | A1 | 6/2014 | Hatzinikolas | |
| 2014/0190110 | A1 | 7/2014 | Hatzinikolas | |
| 2015/0059259 | A1 | 3/2015 | Hatzinikolas | |
| 2016/0201314 | A1 | 7/2016 | Hatzinikolas | |
| 2016/0305113 | A1 | 10/2016 | Hatzinikolas | |
| 2017/0284104 | A1 | 10/2017 | Hatzinikolas | |
| 2019/0024381 | A1 | 1/2019 | Hatzinikolas | |
| 2020/0190814 | A1 | 6/2020 | Hatzinikolas et al. | |
| 2020/0318341 | A1 * | 10/2020 | Jablonsky | E04B 1/215 |

FOREIGN PATENT DOCUMENTS

| | | | | |
|---|---|---|---|---|
| CA | 1 251 336 | A | 3/1989 | |
| CA | 1 294 457 | C | 1/1992 | |
| CA | 2 034 085 | C | 2/1995 | |
| CA | 2 254 510 | A1 | 5/2000 | |
| CA | 2 284 069 | C | 5/2000 | |
| CA | 2 591 687 | A1 | 5/2000 | |
| CA | 2 759 747 | A1 | 5/2000 | |
| CA | 2 759 778 | A1 | 5/2000 | |
| CA | 2 759 837 | A1 | 5/2000 | |
| CA | 2 102 297 | C | 1/2001 | |
| CA | 2 249 509 | C | 6/2005 | |
| CA | 2 700 636 | C | 10/2012 | |
| CA | 2 518 030 | C | 6/2013 | |
| CA | 2 769 821 | A1 | 8/2013 | |
| CA | 2 865 824 | A1 | 9/2013 | |
| CA | 2 738 488 | C | 4/2015 | |
| CA | 2 804 542 | C | 5/2015 | |
| CA | 2 872 778 | A1 | 6/2016 | |
| CA | 2 872 780 | A1 | 6/2016 | |
| CA | 2 888 404 | A1 | 10/2016 | |
| DE | 77 14 716 | U1 | 9/1977 | |
| DE | 32 39 161 | A1 | 5/1983 | |
| DE | 39 10 286 | A1 | 10/1990 | |
| DE | 44 41 051 | A1 | 5/1996 | |
| DE | 101 171 99 | A1 | 10/2002 | |
| DE | 202007016115 | U1 * | 5/2009 | E04B 1/762 |
| EP | 0 566 829 | A1 | 10/1993 | |
| EP | 0 869 232 | A1 | 10/1998 | |
| EP | 1 211 364 | A2 | 6/2002 | |
| EP | 1 353 021 | B1 | 10/2003 | |
| EP | 1 375 777 | A1 | 1/2004 | |
| EP | 2 397 622 | A1 | 12/2011 | |
| FR | 2 738 025 | A1 | 2/1997 | |
| GB | 2062058 | A * | 5/1981 | E04B 1/2612 |
| GB | 2 263 918 | A | 8/1993 | |
| GB | 2 288 831 | A | 11/1995 | |
| GB | 2289906 | A * | 12/1995 | E04B 1/4178 |
| GB | 2316103 | A * | 2/1998 | E04B 1/2612 |
| GB | 2 375 552 | A | 11/2002 | |
| GB | 2417039 | A * | 2/2006 | E04F 13/0857 |
| GB | 2443262 | A * | 4/2008 | E04B 1/4178 |
| GB | 2487280 | A * | 7/2012 | E04B 1/4178 |
| GB | 2 505 980 | A | 3/2014 | |
| IE | 2013/0144 | A1 | 11/2013 | |
| KR | 2005121764 | A * | 12/2005 | E04B 1/4178 |
| KR | 20100004985 | U * | 5/2010 | E04B 1/2612 |
| KR | 1541411 | B1 * | 8/2015 | E04F 13/0801 |
| WO | WO-0131135 | A1 * | 5/2001 | E04F 13/0801 |
| WO | 2019014740 | A1 | 1/2019 | |

OTHER PUBLICATIONS

Fero Fast Angle Support Technology, Wayback Machine, Mar. 17, 2012, pp. 1-4.

Bespoke Bracket Angle Support, Ancon Ltd, pp. 1-6.

Non-Welded Bracket Angle Support, Ancon Ltd, pp. 1-5.

Mortar Collection Systems, HB Mortar Trap tm with CMU Detail, 1 pages.

* cited by examiner

FACADE SUPPORT SYSTEM

CROSS-REFERENCE TO RELATED APPLICATION

The present application claims priority to Provisional App. No. 62/968,671, filed Jan. 31, 2020, the entirety of which is hereby incorporated by reference.

FIELD

The present disclosure generally relates to a facade support system used in building construction, and more specifically, to a thermally insulating facade support system.

BACKGROUND

A facade can be a durable and aesthetically desirable construction for a building exterior. Facades, such as brick or stone veneer walls, also provide protection to the interior of the building from the surrounding environment. Facade supports are typically metal structures attached to inner walls of the building and provide a support surface for the outer veneer wall and transfer the load of the veneer wall to the inner walls of the building. Facade supports can also penetrate insulation used within the building walls. However, thermal bridging occurs when the insulation is penetrated by material with relatively high thermal conductivity, such as the metal supports, and this can affect the overall thermal performance of the building. Minimizing the thermal bridging caused by the facade supports can be beneficial to the thermal performance of the building. Additionally, it is important to ensure that the facade supports are properly attached to the inner walls of the building so that the outer veneer can be constructed to be level.

SUMMARY

In one aspect, a facade support system for attachment to a floor of a structure for supporting a veneer on the structure comprises a bracket configured for attachment to the floor. The bracket includes a back panel, a connecting member extending from the back panel in a first direction and a top flange extending from the back panel in a second direction that is generally opposite the first direction. The top flange is configured to be attached to an underside of the floor. A support is configured to be attached to the connecting member of the bracket and is configured to be disposed in a mortar bed joint of the veneer.

In another aspect, a facade support system for attachment to a floor of a structure for supporting a veneer on the structure comprises a bracket configured for attachment to the floor. The bracket includes a back panel, a connecting member secured to the back panel and a top flange at upper ends of the back panel and the connecting member. The top flange is configured to be attached to an underside of the floor. A support is configured to be attached to the connecting member of the bracket and is configured to be disposed in a mortar bed joint of the veneer.

In another aspect, a façade support bracket for use in attaching a façade support to a floor of a structure, the support bracket comprises a back panel and a connecting member extending from the back panel in an outward direction to an outer edge. The connecting member including a hook extending from the outer edge configured to engage the façade support for connecting the façade support to the façade support bracket. A top plate arranged to be transverse to both the back panel and the connecting member includes at least one opening directed on an axis that is perpendicular to the top plate and parallel to the back panel.

In yet another aspect, a facade support system for attachment to a framework of a structure for supporting a veneer on the structure comprising a bracket configured for attachment to the framework. The bracket includes a back panel, a connecting member secured to the back panel and configured to attach to a support configured to be disposed in a mortar bed joint of the veneer, and a first bracket interlocking member. A washer is attachable to the bracket for attaching the bracket to the framework. The washer includes a first washer interlocking member configured to engage the first bracket interlocking member to inhibit movement of the washer and the bracket relative to one another.

In a further aspect, a method for forming a facade support system includes forming a bracket and a washer. Forming the washer includes cutting out a cutout section from material used to form of the bracket and forming the washer from said cutout section.

Other aspects and features of the present disclosure will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
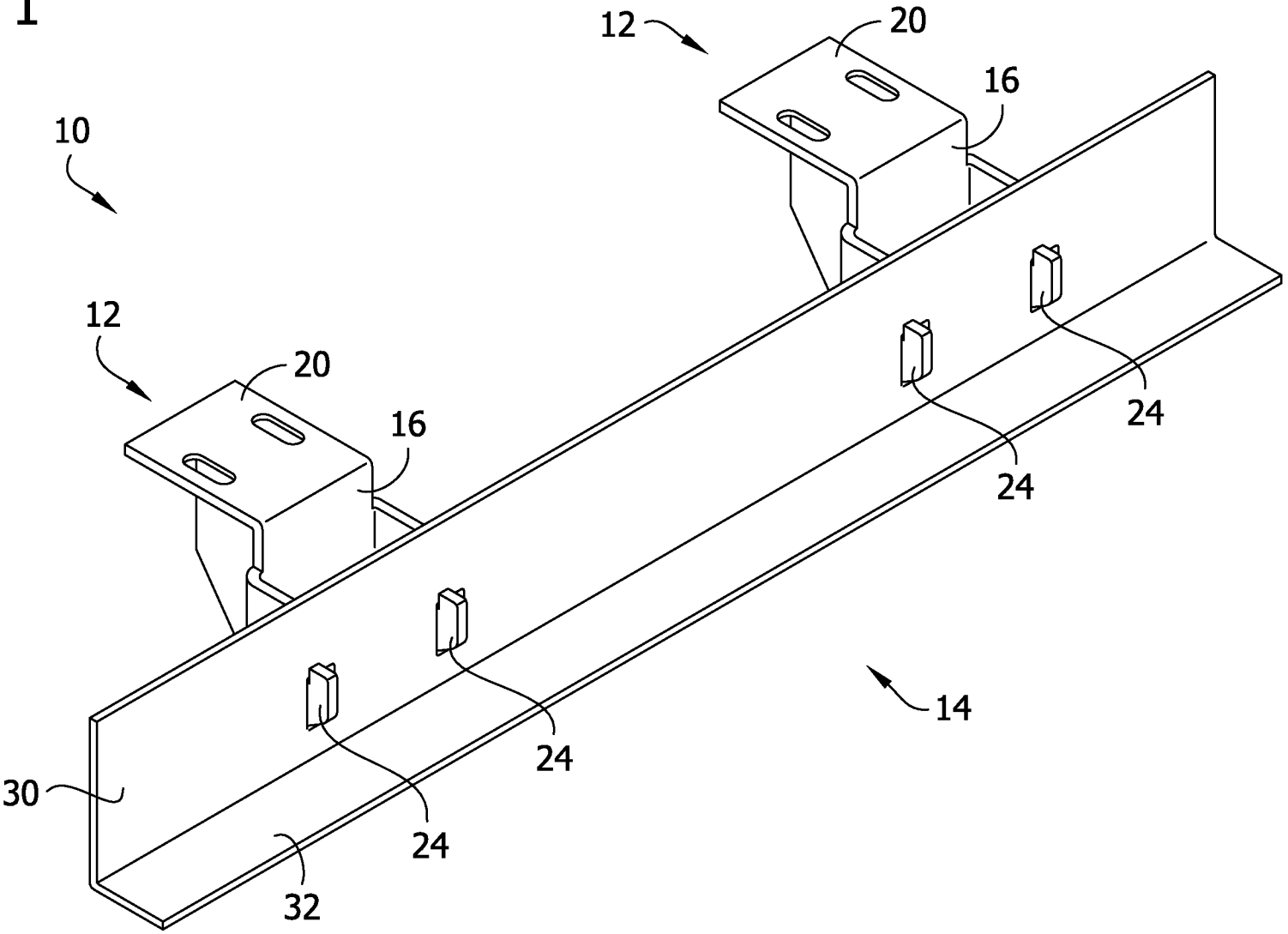
FIG. 1 is a perspective of a facade support system according to one embodiment of the present disclosure.
Figure 2:
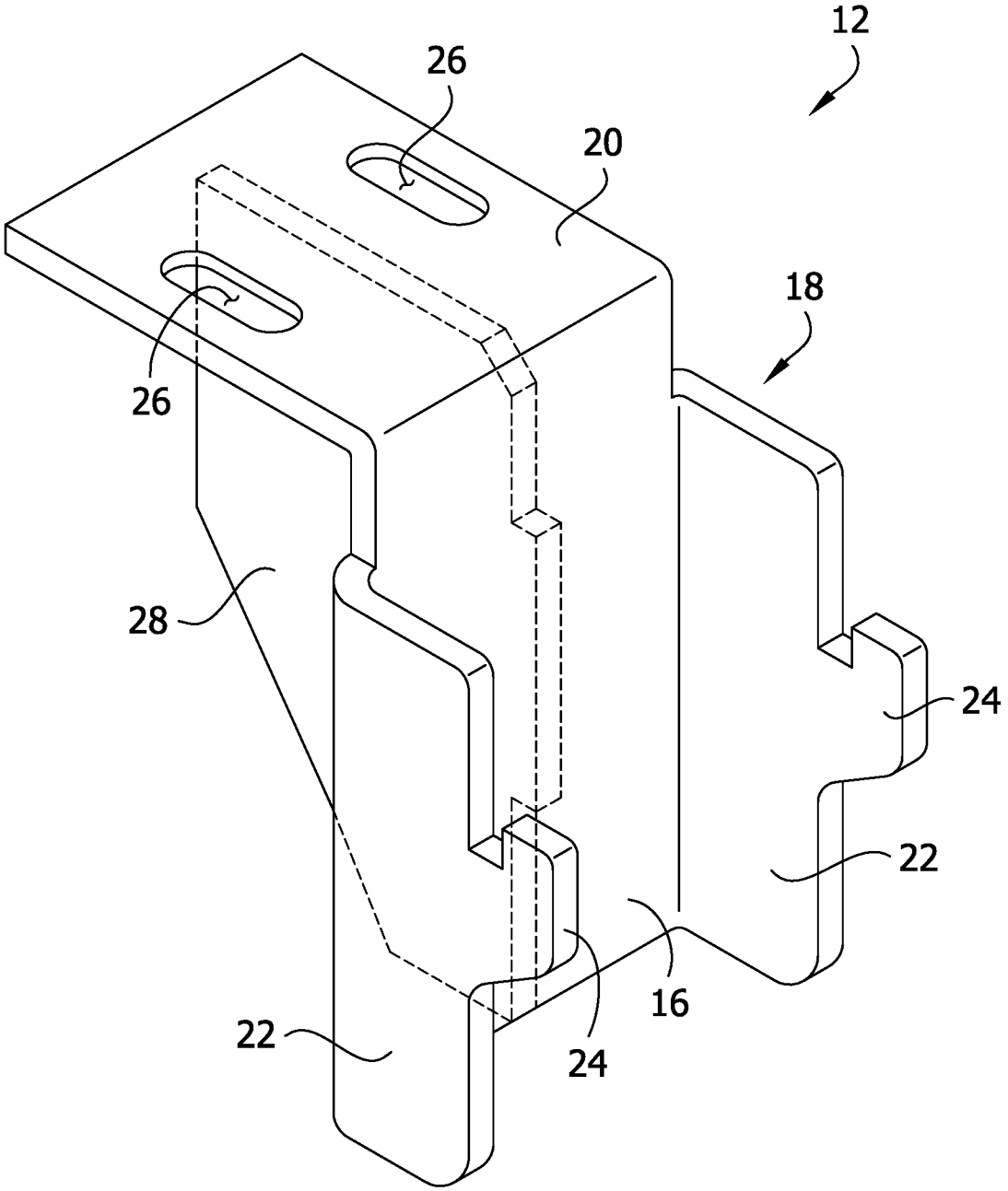
FIG. 2 is a perspective of a bracket of the facade support system.
Figure 3:
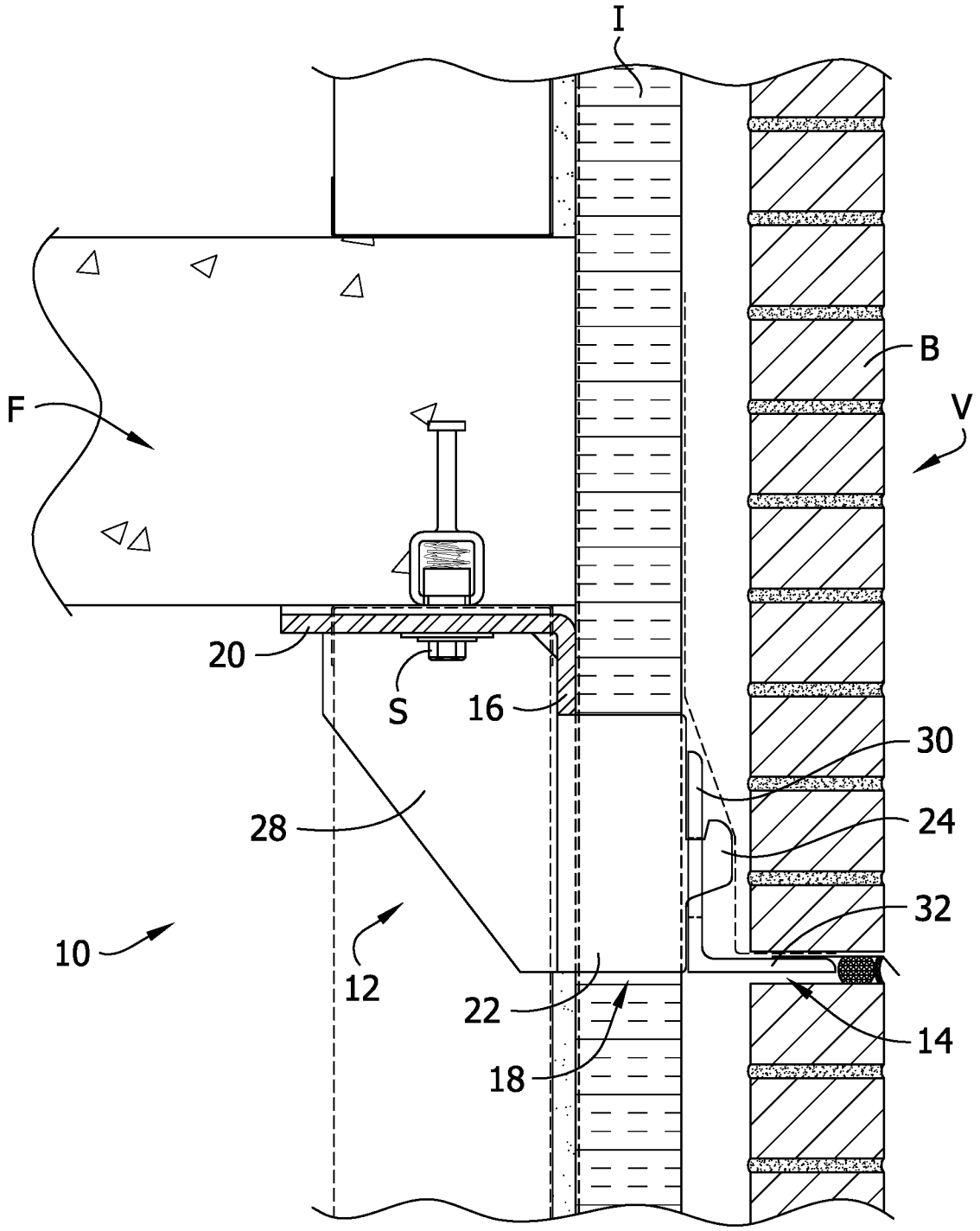
FIG. 3 is a fragmentary cross-section of a building having a veneer wall with the facade support system attached to a floor of the building.

Referring to FIGS. 1-3, a facade support system indicated generally at 10 includes spaced apart support brackets 12 (broadly, a bracket) and a support angle 14 (broadly, a support) attached to the support brackets for supporting the weight of a veneer wall V made up of bricks B, in the illustrated embodiment, to form a building's (e.g., structure's) brick facade. It will be understood that stone or other suitable veneer may be supported using the facade support system 10 of the present disclosure. The brackets 12 are attached to framework F (e.g., floor, slabs, columns, beams, joists, roof and/or any other structural supporting members) of the building. In the illustrated embodiment, the brackets 12 are attached to the floor (e.g., concrete floor slab) of the building. The support system 10 transfers the weight of the bricks B to the framework F. Thus, the facade support system 10 supports the weight of the bricks B forming the building facade. The facade support system 10 is configured so that it is concealed within the bricks B when the facade is complete. Insulation I may be disposed around the brackets 12 between the framework F and the bricks B. The narrow profile configuration of the brackets 12 allows for less penetration of the insulation thereby reducing the amount of thermal bridging and energy loss throughout the building.

Each support bracket 12 includes a back panel or plate 16, a connecting member 18 and a top flange or plate 20. The connecting member 18 is configured to be attached to the support 14. The connecting member 18 extends from the back panel 16 in a first or outward direction. The connecting member 18 is also configured to extend through the insulation I (FIG. 3). In the illustrated embodiment, the connecting member 18 includes two arms 22 (e.g., side flanges or plates) extending forward from opposite side edge margins of the back panel 16. The end of each arm 22 includes a connection member 24 used to attach the support bracket 12 to the support angle 14, as described in more detail below. In the illustrated embodiment, the connection member 24 comprises a hook, although other configurations are within the scope of the present disclosure. The top flange 20 is configured to be attached to the framework F of the building to connect the support bracket 12 to the framework F. Specifically, the top flange 20 is configured to be attached to an underside of the concrete floor slab, as shown in FIG. 3. It is understood the top flange 20 can be attached to other surfaces such as the underside of a beam or joist. The top flange 20 extends from the back panel 16 in a second or inward direction, which is generally opposite the first direction. The front edge margin of the top flange 20 is connected to the top edge margin of the back panel 16. The back panel 16, the top flange 20 and the two arms 22 are all generally perpendicular to one another. The top flange 20 includes two elongated slots 26 (broadly, openings) each configured to receive a fastener S to connect the top flange to the framework F. The slots 26 are elongate in the second direction (i.e., generally parallel to the first and second directions) to facilitate the adjustment of the support angle 14. The slots 26 allows for the support bracket 12 to account for the framework F being out of plumb.

The support bracket 12 may also include a gusset 28 to brace the back panel 16. The gusset 28 is secured to the back panel 16 and the top flange 20 in a suitable manner such as by welding. In the illustrated embodiment, the gusset 28 is secured to a lower surface of the top flange 20 and a rear surface of the back panel 16. By bracing the back panel 16, the gusset 28 prevents or inhibits the back panel from bending relative to the top flange 20 under the weight of the veneer wall V (e.g., bricks B). Thus, the gusset 28 increases the load bearing capacity of the facade support system 10. In the illustrated embodiment, only one gusset 28 is shown but it is understood that more gussets could be employed, or the gusset could be omitted. The illustrated gusset 28 is generally secured to the middle of the top flange 20 (e.g., extends along the middle of the top flange) and to the middle of the back panel 16 (e.g., extends along the middle of the back panel). This placement maximizes the bracing provided by the single gusset 28. In embodiments with multiple gussets, other arrangements can be used. The gusset 28 lies (e.g., defines) in a gusset plane, the back panel 16 lies in a back panel plane and the top flange 20 lies in a top flange plane. In the illustrated embodiment, the gusset plane is generally perpendicular to the back panel plane and the top flange plane. The support bracket 12 could have a different shape and configuration without departing from the scope of the present disclosure.

The support angle 14 is attached to the connecting member 18 of the support bracket 12. Specifically, the support angle 14 is attached to the two arms 22 via the hooks 24. The support angle 14 includes a first, vertical flange or plate member 30 and a second, horizontal flange or plate member 32 extending from a bottom or lower edge margin of the first plate member. The first plate member 30 includes several slots (FIG. 1) each configured to receive one of the hooks 24 of the connecting member 18 to attach the support angle 14 to the support bracket 12. Other ways of attaching the support angle 14 to the support bracket 12 are within the scope of the present disclosure. For example, the support angle 14 can be attached to the support bracket 12 by welding. The support angle 14 is configured to be disposed in the mortar bed joint of the veneer wall V. Specifically, the horizontal plate member 32 is configured to be disposed in a mortar bed joint between adjacent courses of bricks B. The horizontal plate member 32 is thin and flat so as not to significantly alter the height of the mortar bed joint in which it is received. The horizontal plate member 32 is planar and free of projections from its top or bottom surfaces. Thus, the support angle 14 can be positioned anywhere along a length of a mortar bed joint.

Figure 4:
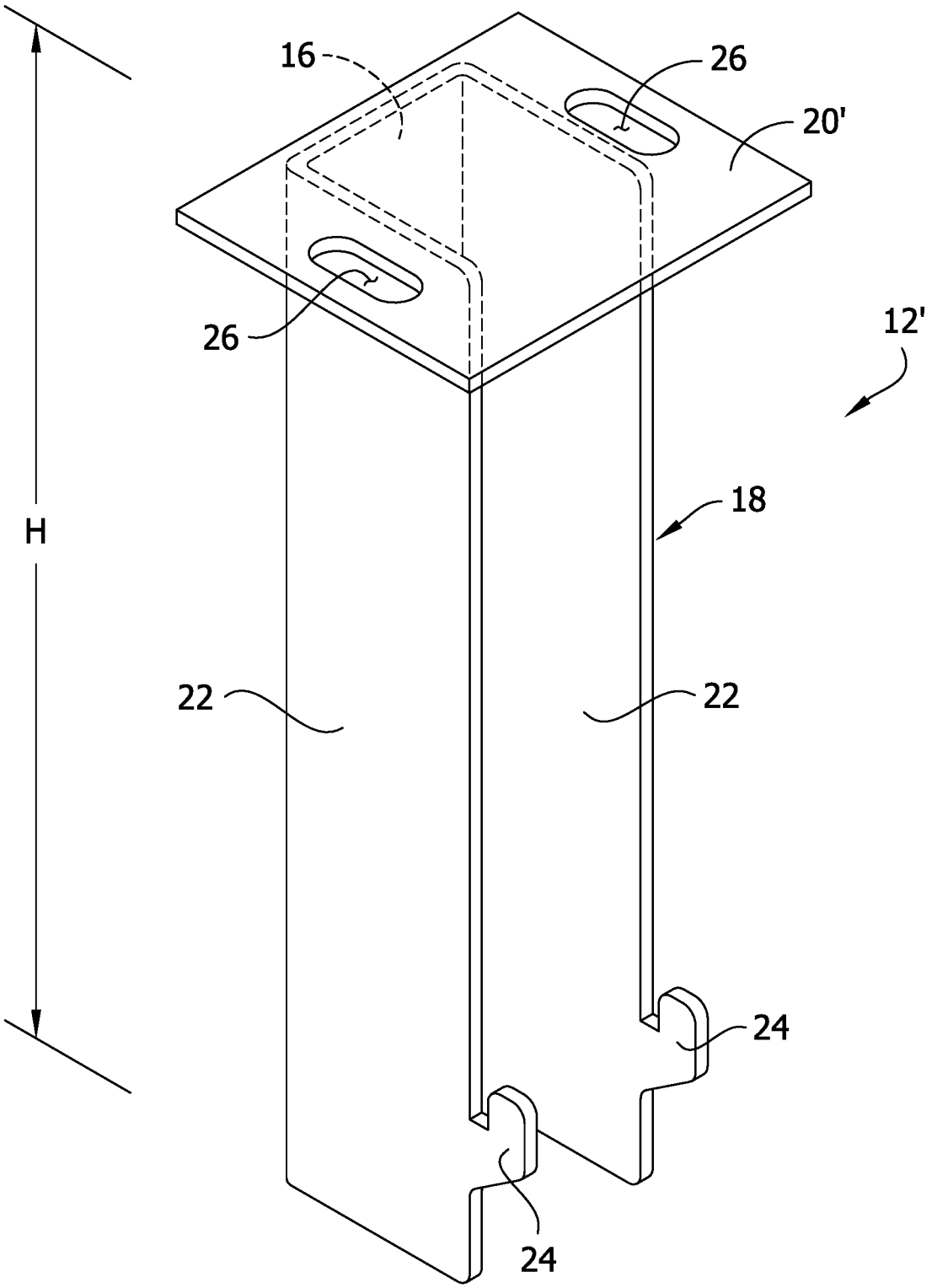
FIG. 4 is a perspective of another embodiment of a bracket.
Figure 5:
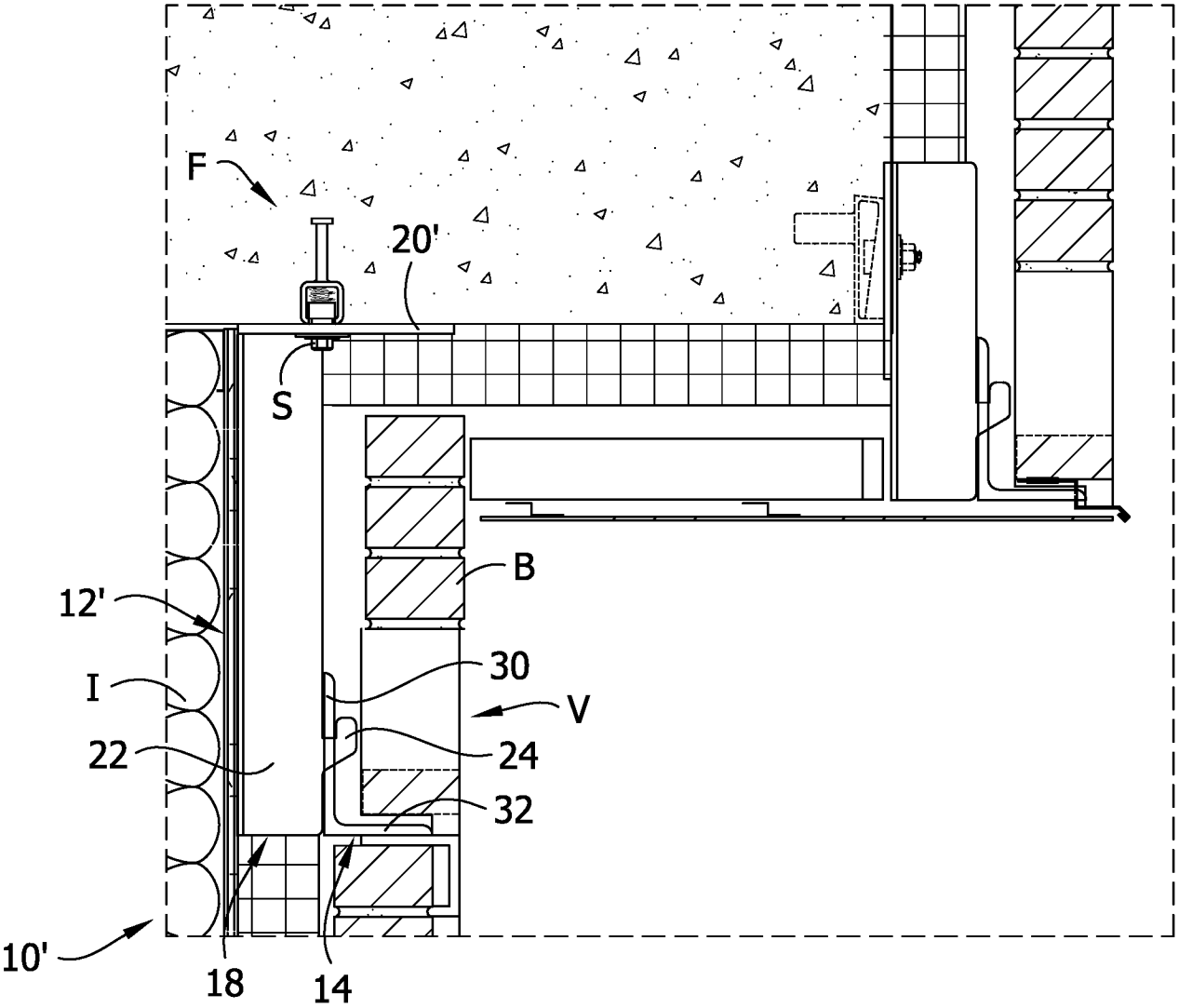
FIG. 5 is a fragmentary cross-section of a building having a veneer wall with a facade support system including the bracket of FIG. 4 attached to a floor of the building.

Referring to FIGS. 4 and 5, another embodiment of a facade support system is generally indicated at 10'. The facade support system 10' includes a support bracket 12', which is generally similar to support bracket 10, except that the support bracket 12' includes a top flange 20' at the upper end of the back panel 16 and the upper end of the connecting member 18. Specifically, the top flange 20' overlies the back panel 16 and the connecting member(s) 18. Broadly, the top flange 20' overlies at least a portion of at least one of the back panel 16 or connecting member 18 (e.g., arms 22). In the illustrated embodiment, the top flange 20' is secured, such as by welding, to the back panel 16 and the connecting member(s) 18. The configuration of the support bracket 12' enables the bracket to be attached to the underside of an overhang (e.g., the floor of the overhang), as shown in FIG. 5. Accordingly, the facade support system 10' is configured to be attached to an overhang to support at least a portion of the veneer wall V disposed below the overhang. In this embodiment, slots 26 in the top flange 20' are disposed outward of the arms 22 to permit access and allow a fastener S to secure the support bracket 12 to the underside of the overhang. It is understood that the facade support system 10' may be used in other arrangements, besides overhangs. For example, the facade support system 10' can be attached to a beam or joist. In this embodiment, the height H of the support bracket 12' is also larger than the height of the support bracket 12 in order to accommodate more courses of bricks B between the support angle 14 and the overhang. Otherwise, the facade support system 10' is generally configured identically to the facade support system 10. Accordingly, it is understood that the descriptions related to the facade support system 10 also apply to facade support system 10', unless indicated otherwise.

Figure 6:
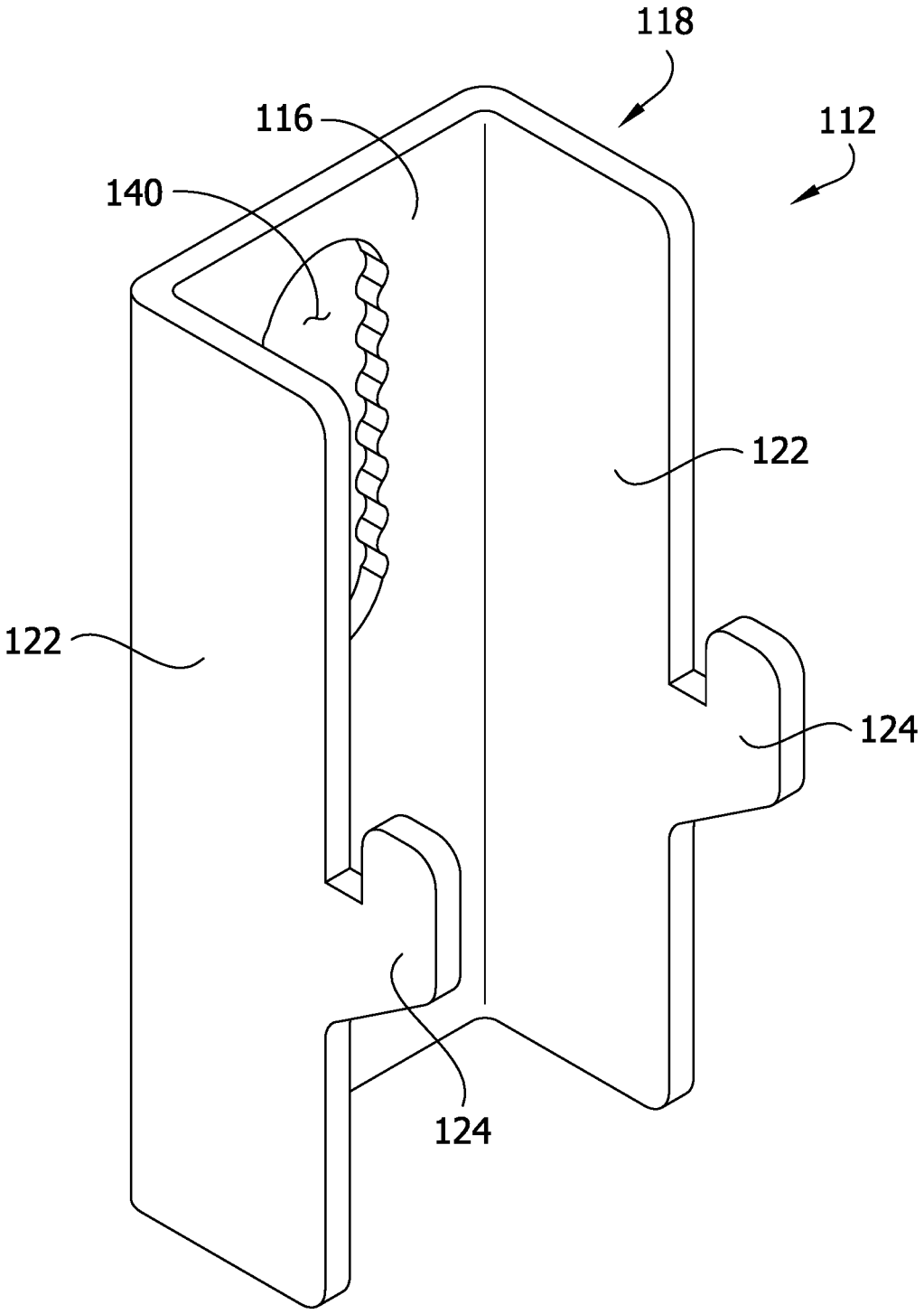
FIG. 6 is a perspective of another embodiment of a bracket.
Figure 7:
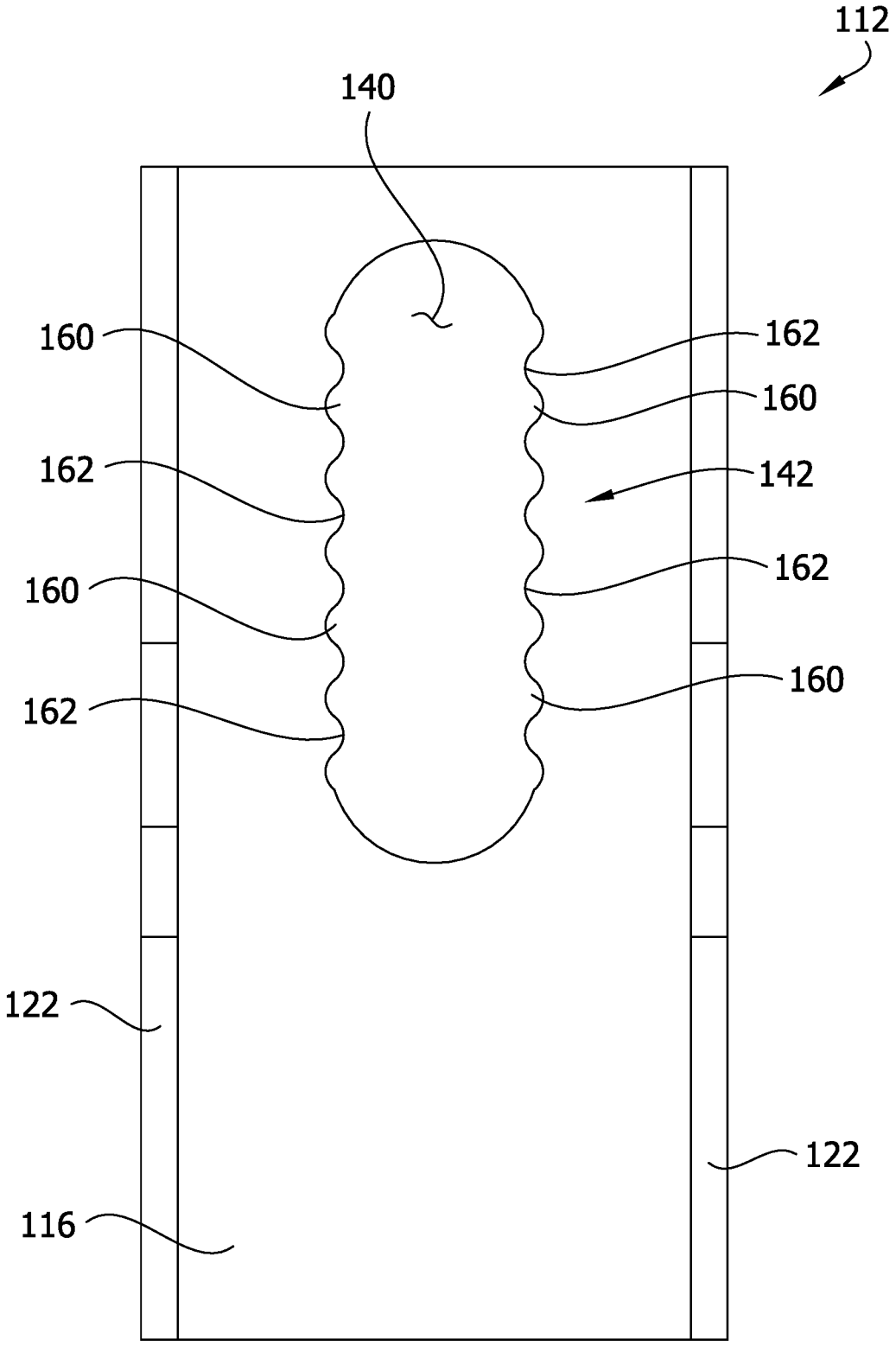
FIG. 7 is a front view of the bracket of FIG. 6.
Figure 8:
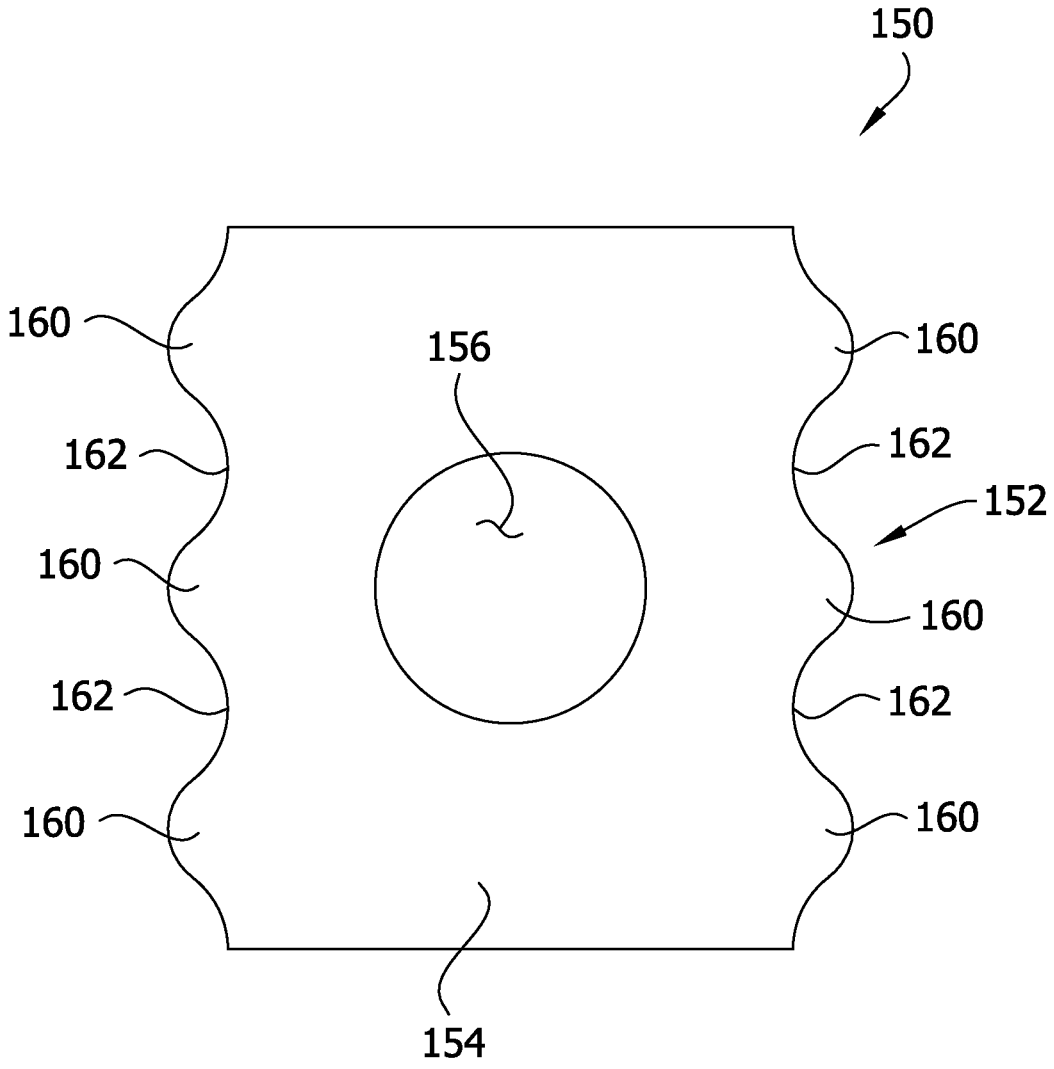
FIG. 8 is a front view of a washer to be used with the bracket of FIG. 6.

Referring to FIGS. 6-8, another embodiment of the support bracket for a facade support system is generally indicated at 112. Support bracket 112 can be used with the support angle 14 to support the veneer wall V. The support bracket 112 is similar to support brackets 12, 12' and, thus, for ease of comprehension, where support bracket 112 includes similar or analogous elements to that of support brackets 12, 12', reference numerals 100 units higher are used. One difference between support bracket 112 and support brackets 12, 12' is that support bracket 112 does not include a top flange. Instead, the back panel 116 of the support bracket 112 includes an opening 140 (FIG. 7) configured to receive a fastener S to secure the support bracket to the framework F of the building. In this embodiment, the support bracket 112 is configured to attach to a generally vertical surface of the framework F, such as the side of a floor (e.g., floor slab). However, it is understood that the support bracket 112 can attach to other structural members such as beams or joists.

The facade support system which includes the support bracket 112 also includes a washer 150 (FIG. 8) that can be attached to the support bracket as part of connecting the support bracket to the framework F. In one embodiment, the washer 150 is made from material that is cut out of the support bracket 112 to form the opening 140. For example, the washer can be formed by cutting out a cutout section from the material used to form the bracket and forming the washer from said cutout section. Forming the washer from the cutout section may include adding (e.g., cutting, stamping, etc.) an opening 156. In addition, the washer 150 is cut to be shorter than the height of the opening 140. The washer 150 includes a generally planar plate 154 that defines the opening 156 to receive the fastener S that secures the washer and support bracket 112 to the framework F. The support bracket 112 and washer 150 are configured to interlock (e.g., mechanically interlock) with one another to prevent movement of the support bracket and washer relative to one another. This is different than conventional frictional engagement between major surfaces of a washer and a member which can inhibit movement. For example, with a mechanical interlock, the connection and support remains even if the engagement between the support bracket 112 and washer 50 were entirely without friction. The support bracket 112 includes a bracket interlocking structure 142 (e.g., a first interlocking structure) that is configured to interlock with a washer interlocking structure 152 (e.g., a second interlocking structure) of the washer 150. The bracket and washer interlocking structures 142, 152 mate with one another when the fastener S secures the washer 150 and support bracket 112 to the framework F. In the illustrated embodiment, the bracket and washer interlocking structures 142, 152 are each an alternating arrangement of projections 160 and recesses 162. The projections 160 and recesses 162 have corresponding shapes so that a projection of one interlocking structure 142, 152 can be received within the recess of the other interlocking structure to interlock the support bracket 112 and washer 150. In this embodiment, the washer 150 is received in the opening 140 of the support bracket 112 so that the projections 160 of the washer 150 are received in the recesses 162 of the support bracket and vice versa (e.g., the bracket and washer interlocking structures interlock).

The opening 140 has a height that is greater than the height of the washer 150. The washer 150 may thus be disposed at different, indexed positions within the opening 140. This allows for the vertical adjustment of the support bracket 112 relative to the fastener S used to secure the support bracket to the framework. Therefore, the vertical position of the support bracket 112 and support angle 14 can be adjusted in the field to be placed in a mortar bed joint between adjacent courses of bricks B. Due to the configurations of the bracket and washer interlocking structures 142, 152, the support bracket 112 can be moved at discrete intervals or steps relative to the washer 150 to adjust the vertical position of the support bracket. In the illustrated embodiment, the bracket interlocking structure 142 is integral to (e.g., a part of) the back panel 116. Similarly, the washer interlocking structure 152 is integral to the plate 154 of the washer 150. In addition, the bracket interlocking structure 142 (e.g., both projections 160 and recesses 162) includes a first bracket interlocking structure positioned on one side of the opening 140 and a second bracket interlocking structure on the opposite side of the opening (e.g., the first and second bracket interlocking structures define opposite sides of the opening). Likewise, the washer interlocking structure (e.g., both projections 160 and recesses 162) includes a first washer interlocking structure and a second washer interlocking structure positioned on opposite sides of the plate 154. The first bracket and washer interlocking structures engage one another and the second bracket and washer interlocking structures engage one another to inhibit movement of the washer and the bracket relative to one another. Other configurations of the interlocking structures 142, 152 are within the scope of the present disclosure. For example and without limitation, only one side of the washer 150 and opening 140 may include the interlocking structures, or the interlocking structures 142, 152 could be straight edges of a polygon. Moreover, the opening 140 and washer 150 may be of other shapes.

The support brackets 112 and support angle 14 are attached to the framework F. Each bracket 112 is attached by inserting the washer 150 into the opening 140 and mating the first and second interlocking structures 142, 152 at a selected position. The washer 150 and the support bracket 112 are secured to the framework F by inserting a fastener S, such as a bolt, through the opening 156 in the washer 150 (and by extension the opening 140) and into the framework. A conventional washer (not shown) that extends over the washer 150 and portions of the support bracket 112 may also be used to secure the washer 150 in the opening 140 of the support bracket. Additionally, the second interlocking structure 152 of the washer 150 mates with the first interlocking structure 142 of the support bracket 112 to lock the washer in place on the support bracket thus substantially preventing any relative vertical movement between the two. However, prior to locking the washer 150 to the support bracket 112, the interlocking structures 142, 152 (e.g., the recesses 160 and projections 162) allow for the relative positions of the washer and the support bracket to be adjusted to suit the construction of the framework F so that the support bracket and angle support 14 are oriented and disposed in the desired position for supporting the bricks 16. For example, the support bracket 112 can be moved upwards and downward relative to the washer 150 to locate the support bracket and angle support 14 in the desired vertical position. This adjustment may be necessary to account for any skewed positioning in the framework F.

In one embodiment, the projections 160 and recesses 162 of the bracket and washer interlocking structures 142, 152 each have a height of about ¼ in (6 mm) (e.g., adjacent projections are spaced apart by about ¼ in (6 mm) and adjacent recesses are spaced apart by about ¼ in (6 mm)). This closely spaced separation of the projections 160 and recesses 162 allows for fine-tuned adjustment of the position of the support bracket 112 relative to the washer 150. Other degrees of spacing are also envisioned without departing from the scope of the disclosure. In one embodiment, a height of the opening 140 can be selected based on the level of adjustment desired for a given building framework F. The longer the opening 140 the greater the amount of adjustment that will be available between the support bracket 112 and the washer 150.

The following are statements of example embodiments described in the present disclosure. Although some of the following statements are not currently presented as claims, the statements are believed to be patentable and may subsequently be presented as claims. Associated methods corresponding to the statements or apparatus or systems below, are also believed to be patentable and may subsequently be presented as claims. It is understood that the following statements may refer to and be supported by one, more than one or all of the embodiments described above.

AA. A facade support system for attachment to a framework of a structure for supporting a veneer on the structure, the system comprising: a bracket configured for attachment to the framework, the bracket including a back panel, a connecting member secured to the back panel and configured to attach to a support configured to be disposed in a mortar bed joint of the veneer, and a first bracket interlocking member; and a washer attachable to the bracket for attaching the bracket to the framework, the washer including a first washer interlocking member configured to engage the first bracket interlocking member to inhibit movement of the washer and the bracket relative to one another.

AB. The system of claim AA, wherein the first bracket and washer interlocking members are configured to mate with one another.

AC. The system of claim AA, wherein the first bracket and washer interlocking members each comprise an alternating arrangement of projections and recesses.

AD. The system of claim AA, wherein the bracket includes a second bracket interlocking member and the washer includes a second washer interlocking member configured to engage the second bracket interlocking member to inhibit movement of the washer and the bracket relative to one another.

AE. The system of claim AA, in combination with the support, the support attached to the connecting member of the bracket.

BA. A method of forming a facade support system, the method comprising: forming the bracket and the washer of the facade support system of claim AA; wherein forming the washer includes cutting out a cutout section from material used to form the bracket and forming the washer from said cutout section.

Having described the disclosure in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description and shown in the accompanying drawings shall be interpreted as illustrative and not in a limiting sense.

What is claimed is:

1. A façade support system for attachment to a framework of a structure for supporting a veneer on the structure, the system comprising:

a bracket comprising:

a back panel having a top edge;

a connecting member comprising a first arm extending from the back panel in a first direction to a first outer edge, and a first hook extending proud from the first outer edge of the first arm with the first outer edge extending above and below the first hook, the first hook defining an outer extent of the bracket in the first direction, the bracket further comprises a top flange directly connected to the top edge of the back panel and extending from the back panel in a second direction that is generally opposite the first direction, the top flange configured to be attached to an underside of the framework and including at least one opening through the top flange; and a support comprising a vertical flange having a front face and a back face and comprising a first slot sized and shaped to receive the first hook to attach the support to the bracket, wherein the back face of the vertical flange is configured to engage the first outer edge above and below the first hook and the front face of the vertical flange is configured to be engaged by the first hook, the support comprising a horizontal flange perpendicular to the vertical flange and configured to be disposed in a mortar bed joint of the veneer.

2. The system of claim 1, wherein the bracket further includes a gusset secured to the back panel and the top flange for bracing the back panel.

3. The system of claim 2, wherein the gusset is secured to a lower surface of the top flange and a rear surface of the back panel.

4. The system of claim 2, wherein the gusset lies in a gusset plane, the back panel lies in a back panel plane and the top flange lies in a top flange plane, the gusset plane being generally perpendicular to the back panel plane and the top flange plane.

5. The system of claim 2, wherein the gusset is generally secured to the middle of the top flange and to the middle of the back panel.

6. The system of claim 5, wherein the gusset defines a gusset plane and the top flange comprises a first opening through the top flange on a first side of the gusset plane and a second opening through the top plate on a second side of the gusset plane.

7. The system of claim 6, wherein the first opening and the second opening are respectively elongated in the second direction.

8. The system of claim 1, wherein the connecting member comprises a second arm extending from the back panel in the first direction, a second hook extending from a second outer edge of the second arm.

9. The system of claim 8, wherein the back panel includes opposite first and second side edge margins, the first connecting member extending from the first side edge margin and the second connecting member extending from the second side edge margin.

10. The façade support system of claim 1, wherein the first arm comprises a first top edge and the top edge of the back panel is spaced vertically above the top edge of the first arm.

11. The façade support system of claim 10, wherein the first outer edge of the first arm terminates at the first top edge of the first arm and the first outer edge is configured to terminate at or below a top of the vertical flange of the support.

12. The façade support system of claim 11, further comprising insulation disposed around the bracket and extending from the framework and terminating at or before the outer edge of the arm.

13. The façade support system of claim 11, wherein the first arm vertically extends between the first top edge and a first bottom edge, the first bottom edge opposite the first top edge, wherein a bottom face of the horizontal flange is coplanar with the first bottom edge.

14. The façade support system of claim 13, wherein the back panel comprises a back face and a front face, wherein the back face of the back panel is inset in the second direction from an exterior face of the framework, and the insulation extends in the first direction between the front face of the back panel and the outer edge of the arm.

15. A façade support bracket for use in attaching a façade support to a floor of a structure, the support bracket comprising:

a back panel having a top edge;

a connecting member comprises an arm extending from the back panel in an outward direction to an outer edge, the connecting member including a hook extending proud from the outer edge, the hook defining an outer extent of the support bracket in the outward direction, the hook configured to engage a front face of the façade support and the outer edge configured to engage a back face of the façade support above and below the hook for connecting the façade support to the façade support bracket; and a top plate directly connected to the top edge of the back panel and transverse to both the back panel and the connecting member, the top plate including at least one opening directed on an axis that is perpendicular to the top plate and parallel to the back panel.

16. The façade support bracket of claim 15, wherein the arm comprises a top edge and the top edge of the back panel is spaced vertically above the top edge of the arm.

17. The façade support bracket of claim 16, wherein the at least one opening in the top plate comprises a first opening and a second opening, each opening being directed on an axis that is perpendicular to the top plate and parallel to the back panel.

18. The façade support bracket of claim 16, wherein the outer edge of the arm terminates at the top edge of the arm and the outer edge is configured to terminate at or below the façade support.

19. The façade support bracket of claim 15, wherein the arm is a first arm, the outer edge is a first outer edge, and the hook is a first hook and the connecting member further comprises a second arm extending from the back panel in the outward direction to a second outer edge, a second hook extending proud from the second outer edge, the second hook configured to engage the front face of the façade support and the second outer edge configured to engage a back face of the façade support above and below the second hook.

20. The façade support system of claim 15, further comprising insulation disposed around the bracket and extending from a framework and terminating at or before the outer edge of the arm.

* * * * *